US009711076B2

(12) United States Patent
Lee

(10) Patent No.: US 9,711,076 B2
(45) Date of Patent: Jul. 18, 2017

(54) DISPLAY DEVICE

(71) Applicant: LG DISPLAY CO., LTD., Seoul (KR)

(72) Inventor: Juyoung Lee, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 6 days.

(21) Appl. No.: 14/738,456

(22) Filed: Jun. 12, 2015

(65) Prior Publication Data

US 2015/0379952 A1 Dec. 31, 2015

(30) Foreign Application Priority Data

Jun. 27, 2014 (KR) ..... 10-2014-0080145

(51) Int. Cl.
*G09G 3/36* (2006.01)
*G09G 3/20* (2006.01)

(52) U.S. Cl.
CPC ..... *G09G 3/20* (2013.01); *G09G 3/3648* (2013.01); *G09G 3/3666* (2013.01); *G09G 2300/0413* (2013.01); *G09G 2300/0426* (2013.01); *G09G 2310/0205* (2013.01); *G09G 2310/0283* (2013.01); *G09G 2310/08* (2013.01)

(58) Field of Classification Search
CPC ..... G09G 3/20; G09G 3/3648; G09G 3/3666; G09G 2300/0413; G09G 2300/0426; G09G 2310/0205; G09G 2310/0283; G09G 2310/08
See application file for complete search history.

(56) References Cited

U.S. PATENT DOCUMENTS

2005/0179640 A1* 8/2005 Tanaka ..... G09G 3/3688 345/103
2009/0027323 A1* 1/2009 Choi ..... G02F 1/13471 345/88
2011/0169800 A1 7/2011 Jun et al.
2015/0243212 A1* 8/2015 Lee ..... G09G 3/3216 345/212

FOREIGN PATENT DOCUMENTS

CN 1854829 A 11/2008
CN 102087430 A 8/2011
JP 2014-4821 A 3/2014
WO WO 2014/033999 A1 3/2014

* cited by examiner

*Primary Examiner* — Nelson Rosario
(74) *Attorney, Agent, or Firm* — Birch, Stewart, Kolasch & Birch, LLP

(57) ABSTRACT

A display device can include a display panel having first and second panel blocks, a switching element that selectively connects a first data line formed in the first panel block and a second data line formed in the second panel block, a gate driver that feeds a gate pulse to gate lines formed in the first and second panel blocks, a first data driver that feeds a data voltage to the first data line, a second data driver that feeds a data voltage to the second data line, and a dimming-proof part that controls the operation timing of the switching element.

17 Claims, 8 Drawing Sheets

DISPLAY DEVICE

This application claims the priority benefit of Korean Patent Application NO. 10-2014-0080145 filed on Jun. 27, 2014, which is incorporated herein by reference for all purposes as if fully set forth herein.

BACKGROUND OF THE INVENTION

Field of the Invention

This document relates to a display device.

Discussion of the Related Art

Display devices are visual information transmission media that are used for various types of information equipment, office equipment, etc. Cathode ray tubes or Braun tubes, which are widely used display devices, have disadvantages such as large weight and size. Various types of flat panel displays are being developed to overcome the limitations of cathode ray tubes. In a typical flat panel display, data lines and scan lines are arranged to intersect each other and pixels are arranged in a matrix form. In a liquid crystal display device or an organic light emitting diode device, scan lines may be referred to as gate lines because the gate electrodes of thin film transistors (TFTs) are connected to the scan lines. A video data voltage for display is supplied to the data lines, and a scan pulse (or gate pulse) is sequentially supplied to the scan lines. The video data voltage is supplied to the pixels of display lines to which the scan pulse is supplied, and the video data is displayed as all the display lines are sequentially scanned by the scan pulse.

Nowadays, display devices tend to have bigger screens and higher resolutions. With the bigger screens, data lines for supplying a data voltage to the display panel need to be longer, and hence data charging time may be delayed due to the resistance and capacitance of the data lines.

SUMMARY OF THE INVENTION

An aspect of this document is to provide a display device which is capable of securing data charging time.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF EMBODIMENTS

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention.

A display device according to one or more embodiments of the present invention, may be implemented as a flat panel display such as a liquid crystal display (LCD), a field emission display (FED), a plasma display panel (PDP), an organic light emitting display (OLED), etc. It is to be noted that, while the following embodiments will be described with respect to a liquid crystal display, the display device of this invention is not limited to the liquid crystal display.

Figure 1:
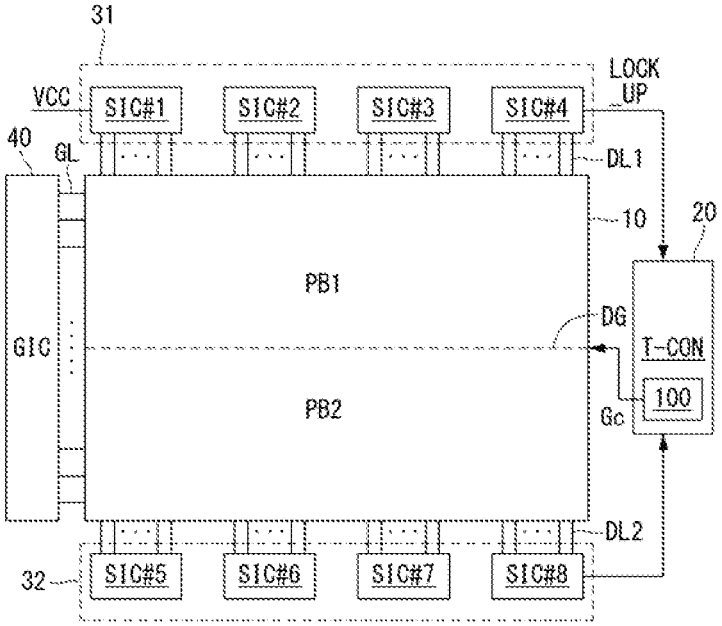
FIG. 1 is a view showing a display device according to an embodiment of the present invention.

Referring to FIG. 1, a liquid crystal display according to an exemplary embodiment of the present invention comprises a liquid crystal display panel 10, a timing controller 20, first and second data drivers 31 and 32, and a gate driver 40. All of the components of the display according to this and other embodiments are operatively coupled and configured.

The liquid crystal display panel 10 comprises a liquid crystal layer formed between substrates. The liquid crystal display panel 10 comprises liquid crystal cells arranged in a matrix form by the intersection of data lines DL and gate lines GL. The liquid crystal display panel 10 comprises first and second panel blocks PB1 and PB2.

Figure 2:
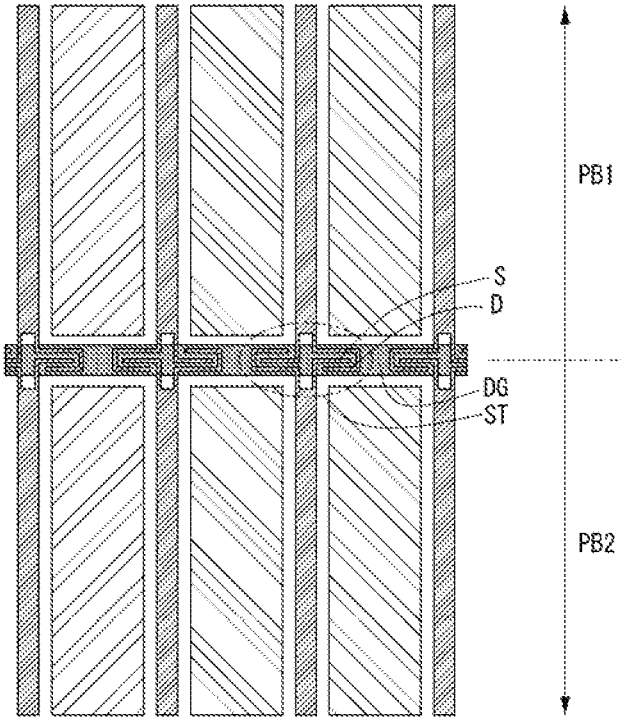
FIG. 2 is a view showing a plane of a thin film transistor array substrate according to an embodiment of the present invention.

A pixel array comprising the data lines DL, the gate lines GL, TFTs, and storage capacitors are formed on a TFT array substrate of the liquid crystal display panel 10. The liquid crystal cells are driven by an electric field between pixel electrodes for supplying a data voltage through the TFTs and a common voltage for supplying a common voltage. The gate electrodes of the TFTs are connected to the gate lines GL, and the drain electrodes of the TFTs are connected to the data lines DL. The source electrodes of the TFTs are connected to the pixel electrodes of the liquid crystal cells. The TFTs are turned on in response to a gate pulse supplied through the gate lines GL to supply a data voltage from the data lines DL1 and DL2 to the pixel electrodes of the liquid crystal cells. A black matrix, color filters, and the common electrode are formed on a color filter substrate of the liquid crystal display panel 10. Polarizers are attached to the TFT array substrate and color filter array substrate of the liquid crystal display panel 10, respectively, and an alignment film for setting a pre-tilt angle of liquid crystal is formed on them. A spacer may be formed between the TFT array substrate and color filter substrate of the liquid crystal display panel 10 to keep cell gaps of the liquid crystal cells Clc. The data lines comprise the first and second data lines DL1 and DL2 formed in first and second panel blocks PB. As shown in FIG. 2, the TFT array substrate can include a switching transistor ST formed on the boundary surface of the first and second panel blocks PB1 and PB2.

The switching transistor ST comprises a dummy gate DG, a drain electrode D, and a source electrode S. The dummy gate DG is formed in the direction of horizontal lines in the region of contact between the first and second data lines DL1 and DL2. The dummy gate DG is formed separately from the gate lines GL, and operates in response to a dummy gate pulse Gc received from a dimming-prevention part 100. The drain electrode D is branched from the first data lines DL1, and the source electrode S is branched from the second data lines DL2. The switching transistor ST electrically connects the first data lines DL1 and second data lines DL2 contacting each other, in response to a turn-on voltage coming through the dummy gate DG.

The liquid crystal display panel 10 may be implemented in a vertical electric field driving scheme, such as TN (Twisted Nematic) mode and VA (Vertical Alignment) mode, or in a horizontal electric field driving scheme, such as IPS (In Plane Switching) mode and FFS (Fringe Field Switching) mode. The liquid crystal display panel 10 of this invention may be implemented as a transmissive liquid crystal display, a transflective liquid crystal display, or a reflective liquid crystal display. The transmissive liquid crystal display and the transflective liquid crystal display require a backlight unit. The backlight unit may be implemented as a direct-type backlight unit or an edge-type backlight unit.

The timing controller 20 receives external timing signals such as vertical/horizontal synchronization signals Vsync and Hsync, an external data enable signal (DE), and a main clock CLK from an external host system (not shown) through an interface, such as an LVDS (Low Voltage Differential Signaling) interface and a TMDS (Transition Minimized Differential Signaling) interface. The timing controller 20 is connected in series to source drive ICs SIC#1 to SIC#8 through data wire pairs.

The timing controller 20 comprises the dimming-proof part 100. The dimming-proof part 100 supplies a dummy gate pulse Gc to the switching transistor ST to control the operation of the switching transistor ST. In a double-bank driving period during which the gate driver 40 sequentially drives the first and second panel blocks PB1 and PB2 at a time, the dimming-proof part 100 feeds a turn-off voltage to the switching transistor ST. Also, in order for the gate driver 40 to sequentially drive a panel area comprising the dummy gate DG, the dimming-proof part 100 feeds a turn-on voltage to the switching transistor ST.

The first and second data drivers 31 and 32 receive video data from the timing controller 20, and convert the video data to an analog data voltage. The first data driver 31 comprises the first to fourth source drive ICs SIC1# to SIC#4, and supplies the data voltage to the first data lines D1 arranged in the first panel block PB1. The second data driver 32 comprises the fifth to eighth source drive ICs SIC5# to SIC#8, and supplies the data voltage to the second data lines D2 arranged in the second panel block PB2. The first to eighth source drive ICs SIC#1 to SIC#8 may be connected to the data lines of the liquid crystal display panel 10 by a COG (chip on glass) process or a TAB (tape automated bonding) process.

The first to eighth source drive ICs SIC#1 to SIC#8 decode control data input through the data wire pairs by code mapping to restore source control data and gate control data. The first to eighth source drive ICs SIC#1 to SIC#8 convert video data of an input image to positive/negative analog video data voltages in response to the restored source control data and supplies it to the first data lines DL1 or second data lines DL2 of the liquid crystal display panel 10. The first to eighth source drive ICs SIC#1 to SIC#8 may transmit gate control data gate drivers 40.

Figure 3:
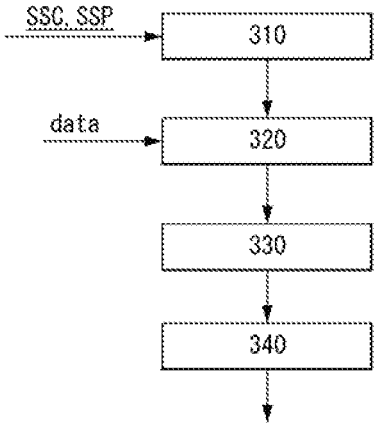
FIG. 3 is a view showing a data driver according to an embodiment of the present invention.

FIG. 3 shows an internal circuit configuration of the first to eighth source drive ICs SIC#1 to SIC#8 according to an embodiment of the present invention.

The first to fourth source drive ICs SIC#1 to SIC#4 supply positive/negative data voltages to a first data lines DL1 formed in the first panel block PB1. The fifth to eighth source drive ICs SIC#5 to SIC#8 supply data voltages to second data lines DL2 formed in the second panel block PB2, on the side opposite to the first to fourth source drive ICs SIC#1 to SIC#4.

The first to eighth source drive ICs SIC#1 to SIC#8 each comprise a shift register 310, a latch part 320, a digital-to-analog converter (hereinafter, "DAC") 330, and an output part 340.

The shift register 310 samples RGB digital video data bits of an input image by using data control signals SSC and SSP received from the timing controller 20. The latch part 320 latches the sampled data bits, and then simultaneously outputs them to the DAC 330. The DAC 330 converts the video data input form the latch part 320 to a positive gamma compensation voltage GMAH and a negative gamma compensation voltage GMAL to generate positive and negative analog video data voltages. The DAC 330 inverts the polarity of a data voltage in response to a polarity control signal POL. The output part 340 outputs the data voltage to the data lines DL1 and DL2 through an output buffer during a low logic period of the source output enable signal SOE. When the source drive ICs SIC#1 to SIC#8 perform charge sharing, the output part 340 supplies the average voltage of the positive and negative data voltages or a common voltage Vcom to the data lines D1 to Dk through the output buffer, by the charge sharing, during a high logic period. During the charge sharing time, positive data voltage output channels and negative data voltage output channels, of the source drive ICs SIC#1 to SIC#8, are short-circuited to supply the average voltage of the positive data voltage and the negative data voltage to the data lines D1 to Dk.

The gate driver 40 may be connected to the gate lines of the TFT array substrate of the liquid crystal display panel 10 by a TAP process, or may be formed directly on the TFT array substrate of the liquid crystal display panel 10 by a GIP (Gate In Panel) process. The gate driver 40 sequentially supplies a gate pulse synchronized with the positive/negative analog video data voltages to the gate line GL, in response to gate control data received directly from the timing controller 20 or received through the source drive ICs SIC#1 to SIC#8.

The gate driver 40 performs both double-bank driving and line-sequential driving.

A method of driving a display device according to the present invention will be discussed below.

Figure 4:
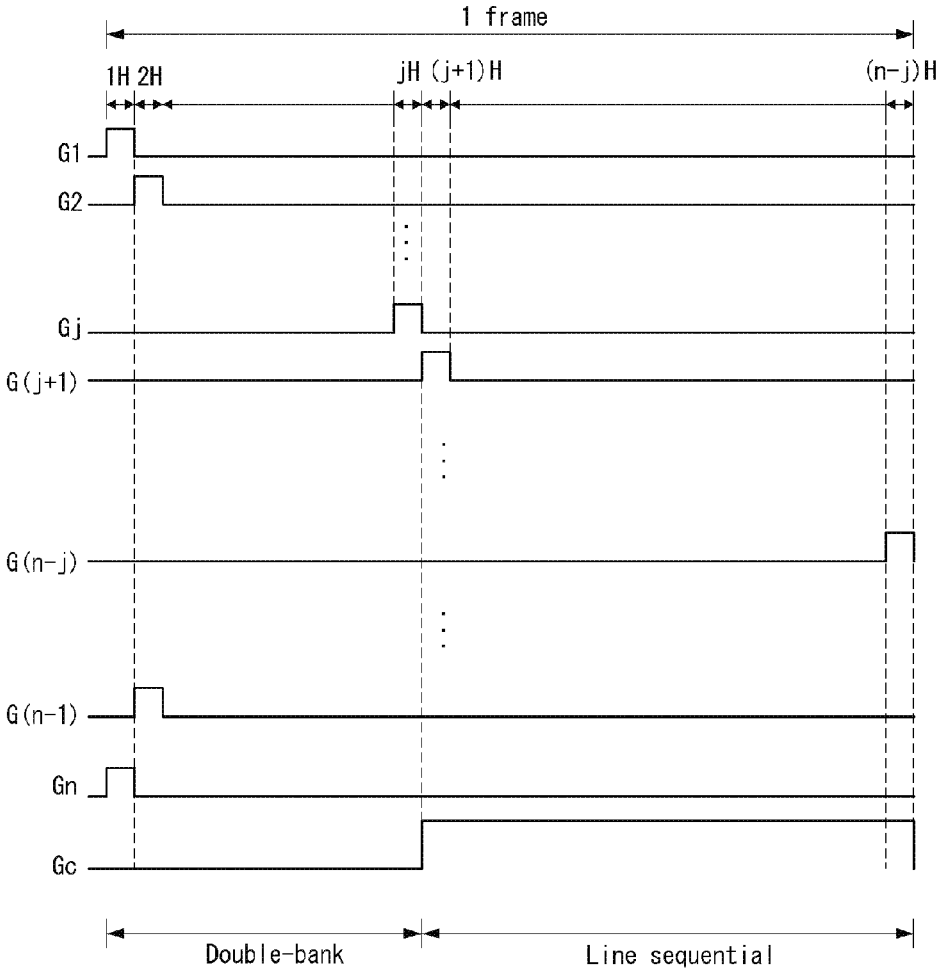
FIG. 4 is a waveform diagram for scanning on a display device according to a first exemplary embodiment of the present invention.
Figure 5:
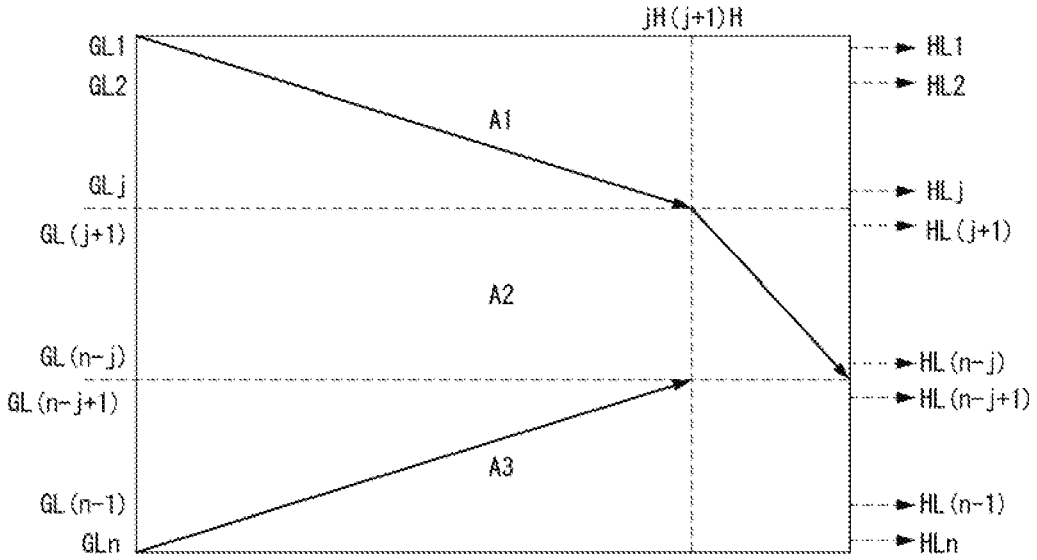
FIG. 5 is a view showing the sequence of scanning gate lines according to the first exemplary embodiment of the present invention.
Figure 6:
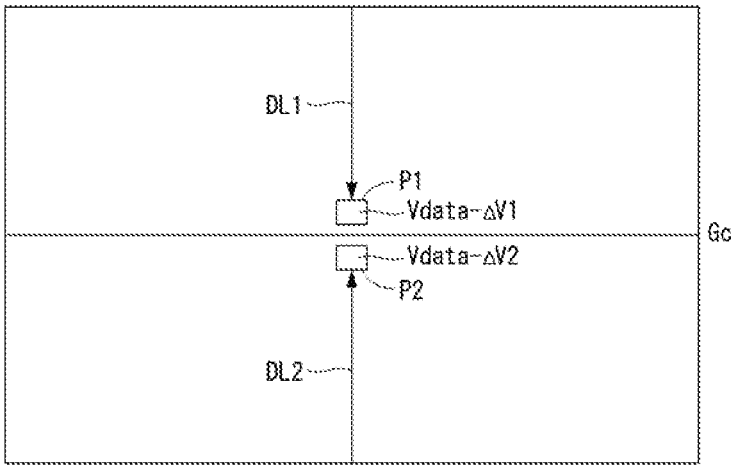
FIG. 6 is a view for explaining the cause of dimming according to an embodiment of the present invention.

FIG. 4 is a view showing the operation timings of gate pulses and dummy gate pulses according to a first exemplary embodiment, and FIG. 5 is a view showing the sequence of scanning gate lines according to the first exemplary embodiment of the present invention.

Referring to FIGS. 4 and 5, the method of driving a display device according to an embodiment of the present invention comprises a double-bank driving period and a line sequential driving period.

During the double-bank driving period, the gate driver 40 sequentially drives the first and second panel blocks PB1 and PB2 at a time to scan horizontal lines HL1 to HLj included in a first area and horizontal lines HL(n−j+1) to HLn included in a third area. In other words, the gate driver 40 sequentially supplies first to jth gate pulses G1 to Gj to first to jth gate lines GL1 to GLj. Also, the gate driver 40, while supplying the first to jth gate pulses G1 to Gj, sequentially supplies nth to (n−j+1)th gate pulses Gn to G(n−j+1) to nth to (n−j+1)th gate lines GL to GL(n−j+1). During the double-bank driving period, the dummy gate pulse DG is maintained at the turn-off voltage.

Specifically, the gate driver 40 feeds the first gate pulse G1 to the first gate line GL1 and the nth gate pulse Gn to the nth gate line GLn, during a first horizontal period 1H. During the first horizontal period 1H, the first data driver 31 feeds a data voltage to the pixels arranged in the first horizontal line HL1 through the first data lines DL1, and the second data drive 32 feeds the data voltage to the pixels arranged in the nth horizontal line HLn through a second data lines DL2. Accordingly, during the first horizontal period 1H, the pixels arranged in the first horizontal line HL1 connected to the first gate line GL1 and the pixels arranged in the nth horizontal line HLn connected to the nth gate line GLn are charged with the data voltage.

Subsequently, the gate driver 40 feeds the second gate pulse G2 to the second gate line GL2 and the (n−1)th gate pulse G(n−1) to the (n−1)th gate line GL(n−1), during the second horizontal period 2H. During the second horizontal period 2H, the second data driver 32 feeds a data voltage to the pixels arranged in the second horizontal line HL2 through the first data lines DL1, and the second data driver 32 feeds the data voltage to the pixels arranged in the (n−1)th horizontal line HL(n−1) through the second data lines DL2. Accordingly, during the second horizontal period 2H, the pixels arranged in the second horizontal line HL2 connected to the second gate line GL2 and the pixels arranged in the (n−1)th horizontal line HL(n−1) connected to the (n−1)th gate line GL(n−1) are charged with the data voltage.

In this way, the pixels arranged in the jth horizontal line HLj and the (n−j+1)th horizontal line HL(n−j+1) are charged with the data voltage during the jth horizontal period jH.

The first data lines DL1 of the first panel block PB1 and the second data lines DL2 of the second panel block PB2 are not electrically connected because the dummy gate pulse Gc is maintained at the turn-off voltage during the double-bank driving period. That is, the data voltage output from the first data driver 31 is not transmitted to the second panel block PB2, and the data voltage output from the second data driver 32 is not transmitted to the first panel bock PB1. Accordingly, a data voltage may be supplied simultaneously to pixels arranged in two horizontal lines during the double-bank driving period.

As such, the gate driver 40 simultaneously scans a pair of gate lines respectively arranged in the first and second panel blocks PB1 and PB2 during the double-bank driving period, so the width of a gate pulse input into a single gate line may be increased. That is, the exemplary embodiment of the present invention allows for increased data scan time through the use of double-bank driving. Accordingly, the exemplary embodiment of the present invention can avoid a high-resolution liquid crystal display panel's failure to display a desired luminance due to lack of data scan time.

During the line sequential driving period, the gate driver 40 sequentially scans the horizontal lines HL(j+1) to HL(n−j) included in the second area.

The dimming-proof part 100 swings the dummy gate pulse Gc to the turn-on voltage when the line sequential driving period starts, and supplies the turn-on voltage to the dummy gate DG until the end of one frame. The switching transistor ST electrically connects the first and second data lines DL1 and DL2, in response to the dummy gate pulse Gc.

During the line sequential driving period, the gate driver 40 sequentially supplies the jth gate pulse Gj to the (n−j)th gate pulse G(n−j).

Specifically, during the (j+1)th horizontal period (j+1)H, the gate driver 40 supplies the (j+1)th gate pulse G(j+1) to the (j+1)th gate line GL(j+1), and the first and second data drivers 31 and 32 simultaneously supply a data voltage to be charged to the pixels arranged in the (j+1)th horizontal line HL(j+1). Accordingly, the pixels arranged in the jth horizontal line HLj are charged during the (j+1)th horizontal period (j+1)H.

In this way, the gate driver 40 scans the pixels arranged in the (j+1)th horizontal line LH(j+1) from to (n−j)th horizontal line LH(n−j) during the (j+1)th horizontal periods (j+1)H to (n−j) horizontal periods (n−j)H.

During the line sequential driving period, the second area A2 receives the data voltage simultaneously from the first and second data drivers 31 and 32 because the first data lines DL1 of the first panel block PB1 and the second data lines DL2 of the second panel block PB2 are electrically connected. This can reduce dimming of the second area A2 located in the center of the liquid crystal display panel 10, caused by different delays of the first and second data lines DL2.

Dimming reduction using the line sequential driving period will be discussed below.

If the double-bank driving continues, first and second pixels P1 and P2 located in a kth column and adjacent to the dummy gate DG receive a data voltage from the first and second data lines DL1 and DL2, respectively. In this case, a first voltage variation ΔV1 caused by a delay of the first data lines DL1 and a second voltage variation ΔV2 caused by a delay of the second data lines DL2 may differ depending on the panel characteristics of the first and second panel blocks PB1 and PB2. As a consequence, the first and second pixels P1 and P2 adjacent to each other are charged with different data voltages. That is, the first and second pixels P1 and P2 have different luminance levels even if they display the same video data. Accordingly, dimming occurs horizontally along the dummy gate DG.

The embodiments of the present invention prevent or minimize luminance difference between adjacent pixels depending on panel characteristics, because the second area A2 comprising the pixels formed along the dummy gate DG receives a data voltage from the first and second data lines DL1 and DL2 during a single line sequential driving operation.

The method of driving a display device according to an embodiment of the present invention comprises double-bank driving for simultaneously scanning the first and second panel blocks PB1 and PB2, so the width of one horizontal period H can be increased across the liquid crystal display panel 10.

Provided that the liquid crystal display panel 10 is formed of n horizontal lines and only one horizontal line is sequentially scanned during one horizontal period 1H, the one horizontal line equals one frame period 1/f (f is an operating frequency) divided by n. That is, the width of 1 horizontal period 1H is 1/(f×n).

In the method of driving a display device according to the first exemplary embodiment, however, 1 horizon period 1H is longer because two horizontal lines are simultaneously scanned. In the first exemplary embodiment, double-bank driving is performed during the scanning of j horizontal lines, and line sequential driving is performed during the scanning of (n−2j) horizontal lines. That is, in the first exemplary embodiment, one frame lasts during the scanning of (n−j) horizontal lines. As a consequence, in the first exemplary embodiment, the width of 1 horizontal period 1H is $1/\{f\times(n-j)\}$.

As such, the method of driving a display device according to the first exemplary embodiment offers an advantage when it comes to displaying a large-screen, high-resolution display panel, because data scan time is secured in a stable manner. Moreover, the method of driving a display device according to the first exemplary embodiment can reduce dimming occurring on the boundary surface of the first and second panel blocks PB1 and PB2.

Figure 7:
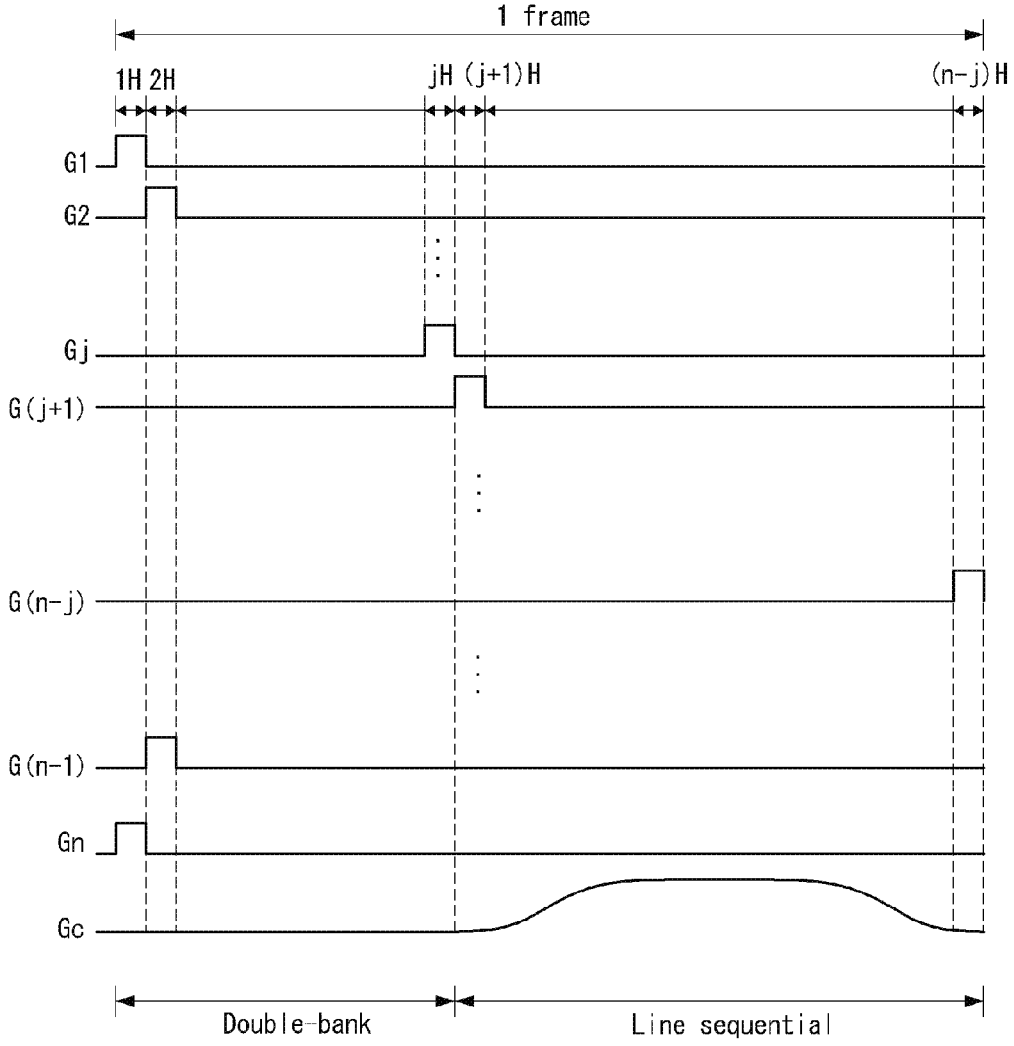
FIG. 7 is a waveform diagram for scanning on a display device according to a second exemplary embodiment of the present invention.

FIG. 7 is a view showing the operation timings of gate pulses and dummy gate pulses according to a second exemplary embodiment of the present invention. Detailed descriptions of any operational redundancies between the first and second exemplary embodiments will be omitted.

Referring to FIG. 7, a method of driving a display device according to the second exemplary embodiment comprises a double-bank driving period and a line sequential driving period. According to the second exemplary embodiment, the voltage level of the dummy gate pulse Gc gradually increases during the line sequential driving period, and on the switching transistor ST is completely turned on before a gate pulse is applied to the horizontal lines located on the boundary surface of the first and second panel blocks PB1 and PB2.

The driving method according to the second exemplary embodiment prevents a quick connection of the first and second data lines DL1 and DL2 because the voltage level of the dummy gate pulse Gc increase in a linear form. In the event of an instantaneous short-circuit, the first and second data lines DL1 and DL2 may get unstable due to their different impedance characteristics. Due to this, dimming may occur in a horizontal line area where line sequential driving starts.

In the method of driving a display device according to the second exemplary embodiment, the switching transistor ST is turned on as the voltage level of the dummy gate pulse Gc gradually increases, thereby preventing the data line characteristics from getting unstable due to an instantaneous short-circuit of the first and second data lines DL1 and DL2. This can avoid the occurrence of dimming in a horizontal line area where a transition from double-bank driving to line sequential driving is made.

The scan direction of gate lines shown in FIG. 5 may apply to both the above-described first and second exemplary embodiments.

Figure 8:
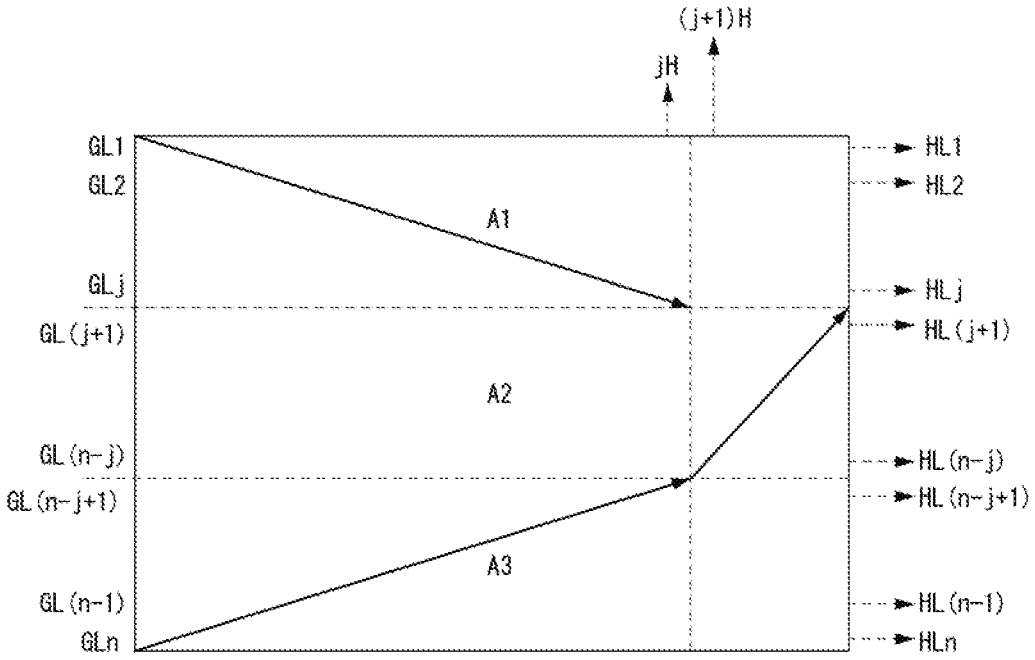
FIG. 8 is a view showing the sequence of scanning gate lines according to the second exemplary embodiment of the present invention.
Figure 9:
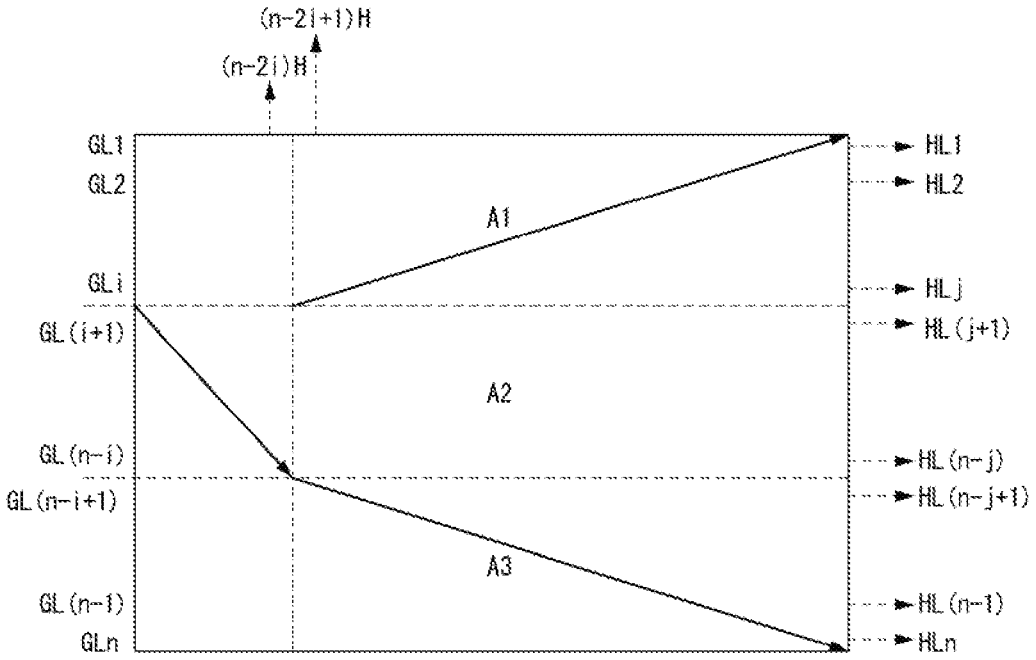
FIG. 9 is a view showing the sequence of scanning gate lines according to a third exemplary embodiment of the present invention.
Figure 10:
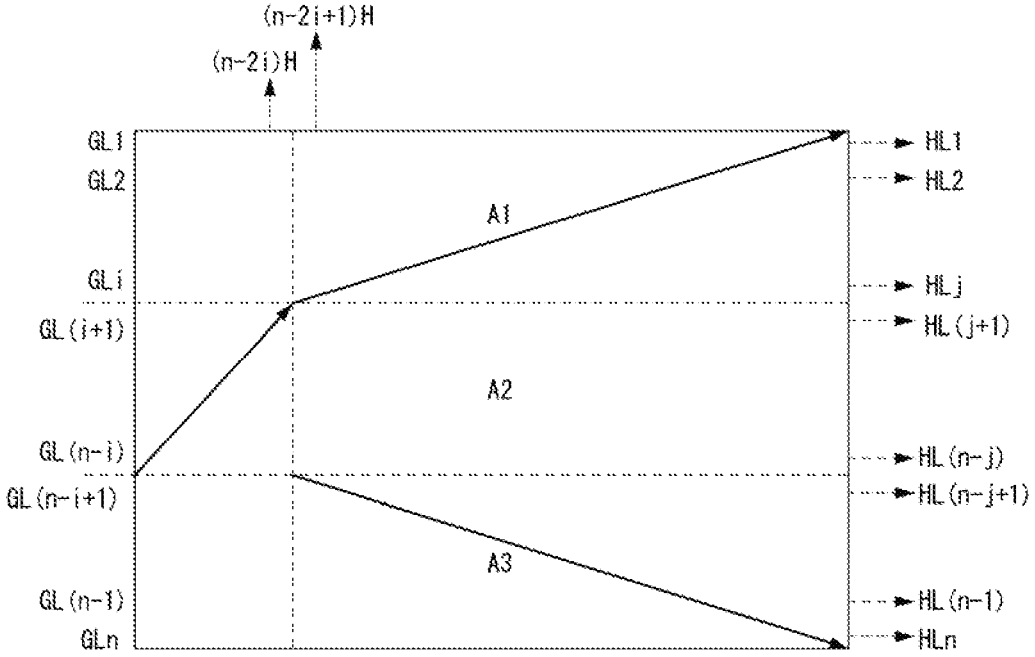
FIG. 10 is a view showing the sequence of scanning gate lines according to a fourth exemplary embodiment of the present invention.

The scan direction of gate lines may be as shown in FIGS. 8 to 10 which are to be discussed below.

FIG. 8 is a view showing the sequence of scanning gate lines according to the second exemplary embodiment of the present invention.

Referring to FIG. 8, the gate driver 40 according to the second exemplary embodiment performs double-bank driving on the first area A1 and the third area A3 during the first to jth horizontal periods.

Then, the gate driver 40 performs line sequential driving on the second area A2, starting from the (j+1)th horizontal period (j+1)H. During the line sequential driving period, the gate driver 40 sequentially feeds a gate pulse to the (n−j)th gate line GL(n−j) to the (j+1)th gate line GL(j+1).

The dimming-proof part 100 turns off the switching transistor ST in order to perform double-bank driving. The dimming-proof part 100 feeds the dummy gate pulse DG to the dummy gate Gc in order to perform line sequential driving.

FIG. 9 is a view showing the sequence of scanning gate lines according to a third exemplary embodiment of the present invention.

Referring to FIG. 9, the gate driver 40 according to the third exemplary embodiment performs line sequential driving first and then performs double-bank driving.

The gate driver 40 performs line sequential driving on the second area A2 during the first to (n−2i)th horizontal periods 1H to (n−2i)H, and sequentially feeds a gate pulse to the (i+1)th to (n−j)th gate lines GL(i+1) and GL(n−j).

Then, the gate driver 40 performs double-bank driving on the first and third areas A1 and A3 until the end of the frame from the start of the (n−2i+1)th horizontal period (n−2+1)H, to feed a gate pulse to the first to ith gate lines GL1 to GLi and the (n−j+1)th to nth gate lines GL(n−j+1) to GLn.

During the first to (n−2)th horizontal periods 1H to (n−2)H, the dimming-proof part 100 feeds the dummy gate pulse Gc to the dummy gate DG in order to perform line sequential driving. The dimming-proof part 100 feeds the turn-off voltage to the dummy gate DG until the end of the frame from the start of the (n−2+1)th horizontal period (n−2+1)H.

Referring to FIG. 10, the gate driver 40 according to a fourth exemplary embodiment performs line sequential driving first and then performs double-bank driving. Detailed descriptions of any redundancies between FIG. 10 and the figures of the foregoing exemplary embodiments will be omitted.

The gate driver 40 sequentially feeds a gate pulse to the (n−i)th gate line (n−j)GL to (i+1)th gate line (i+1)GL, in order to perform line sequential driving. Afterwards, the gate driver 40 performs double-bank driving on the first and third areas A1 and A3.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A display device comprising:

a display panel including first and second panel blocks, the display panel being divided into first, second, and third areas with the second area disposed between the first and third areas;

a switching element that selectively connects a first data line formed in the first panel block and a second data line formed in the second panel block;

a gate driver that feeds a gate pulse to gate lines formed in the first and second panel blocks;

a first data driver that feeds a data voltage to the first data line;

a second data driver that feeds a data voltage to the second data line; and a dimming-proof part that controls an operation timing of the switching element, wherein the switching element is turned off when the gate pulse is provided to the gate lines disposed in the first and third areas in a double-bank driving period, and wherein the switching element is turned on when the gate pulse is provided to the gate lines disposed in the second area including pixels formed along the switching element in a line sequential driving period.

2. The display device of claim 1, wherein the switching element includes:

a dummy gate located on a boundary surface of the first and second panel blocks;

a drain electrode extending from the first data line; and a source electrode extending from the second data line, wherein the first and second data lines are electrically connected in response to a turn-on signal fed from the dimming-proof part to the dummy gate.

3. The display device of claim 1, wherein, in order to scan n gate lines where n is a natural number, the gate driver sequentially drives the first panel block and the second panel block at a time, and the dimming-proof part turns off the switching element, until an end of a jth horizontal period from a start of a frame, where j is a natural number satisfying $1<j<n/2$.

4. The display device of claim 3, wherein the gate driver sequentially drives (j+1)th to (n−j)th horizontal lines, and the dimming-proof part feeds a turn-on signal to the switching element, until an end of the frame from a start of a (j+1)th horizontal period.

5. The display device of claim 1, wherein, in order to scan n gate lines where n is a natural number, the gate driver sequentially drives (i+1)th to (n−i)th gate lines, and the dimming-proof part feeds a turn-on signal to the switching element, until an end of an (n−2i)th horizontal period from a start of a frame.

6. The display device of claim 5, wherein the gate driver sequentially drives the first and second panel blocks at a time, and the dimming-proof part turns off the switching element, until an end of the frame from a start of a (n−2i+1)th horizontal period.

7. The display device of claim 4, wherein the dimming-proof part gradually increases the turn-on signal.

8. The display device of claim 5, wherein the dimming-proof part gradually increases the turn-on signal.

9. A display device comprising:

a display panel including first and second panel blocks, the display panel being divided into first, second, and third areas with the second area disposed between the first and third areas;

a switching element configured to selectively connect a first data line formed in the first panel block and a second data line formed in the second panel block, wherein the second area includes pixels formed along the switching element;

a gate driver configured to provide a gate pulse to gate lines formed in the first and second panel blocks;

a first data driver configured to provide a data voltage to the first data line;

a second data driver configured to provide a data voltage to the second data line; and a dimming-proof circuit configured to control an operation timing of the switching element, wherein the switching element is configured to be turned off when the gate pulse is provided to the gate lines disposed in the first and third areas in a double-bank driving period, and is configured to be turned on when the gate pulse is provided to the gate lines disposed in the second area in a line sequential driving period.

10. The display device of claim 9, wherein the switching element includes:

a dummy gate located on a boundary surface of the first and second panel blocks;

a drain electrode extending from the first data line; and a source electrode extending from the second data line, and wherein the dimming-proof circuit is configured to provide a turn-on signal to the dummy gate to electrically connect the first data line with the second data line.

11. The display device of claim 9, wherein, in order to scan n gate lines where n is a natural number, the gate driver sequentially drives the first panel block and the second panel block at a time, and the dimming-proof circuit turns off the switching element, until an end of a jth horizontal period from a start of a frame, where j is a natural number satisfying $1<j<n/2$.

12. The display device of claim 11, wherein the gate driver sequentially drives (j+1)th to (n−j)th horizontal lines, and the dimming-proof circuit provides a turn-on signal to the switching element, until an end of the frame from a start of a (j+1)th horizontal period.

13. The display device of claim 9, wherein, in order to scan n gate lines where n is a natural number, the gate driver sequentially drives (i+1)th to (n−i)th gate lines, and the dimming-proof circuit provides a turn-on signal to the switching element, until an end of an (n−2i)th horizontal period from a start of a frame.

14. The display device of claim 13, wherein the gate driver sequentially drives the first and second panel blocks at a time, and the dimming-proof circuit turns off the switching element, until an end of the frame from a start of a (n−2i+1)th horizontal period.

15. The display device of claim 12, wherein the dimming-proof circuit gradually increases the turn-on signal.

16. The display device of claim 13, wherein the dimming-proof circuit gradually increases the turn-on signal.

17. A display device comprising:

a display panel including first and second panel blocks;

a switching element that selectively connects a first data line formed in the first panel block and a second data line formed in the second panel block;

a gate driver that feeds a gate pulse to gate lines formed in the first and second panel blocks;

a first data driver that feeds a data voltage to the first data line;

a second data driver that feeds a data voltage to the second data line; and a dimming-proof part that controls an operation timing of the switching element, wherein, in order to scan n gate lines where n is a natural number, the gate driver sequentially drives the first panel block and the second panel block at a time, and the dimming-proof part turns off the switching element, until an end of a jth horizontal period from a start of a frame, where j is a natural number satisfying $1<j<n/2$.

* * * * *